US006689556B2

(12) United States Patent
Kawamoto et al.

(10) Patent No.: US 6,689,556 B2
(45) Date of Patent: Feb. 10, 2004

(54) METHOD OF PRODUCING WATER-SOLUBLE CHAIN-EXTENDED GELATIN, GELATIN PRODUCED BY THE METHOD, AND SILVER HALIDE PHOTOGRAPHIC LIGHT-SENSITIVE MATERIAL CONTAINING THE GELATIN

(75) Inventors: Hiroshi Kawamoto, Minami-Ashigara (JP); Hiroki Sasaki, Minami-Ashigara (JP); Minoru Uchida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 124 days.

(21) Appl. No.: 09/790,557

(22) Filed: Feb. 23, 2001

(65) Prior Publication Data

US 2001/0031437 A1 Oct. 18, 2001

(30) Foreign Application Priority Data

Feb. 24, 2000 (JP) ..... 2000-048166

(51) Int. Cl.[7] ..... G03C 1/005

(52) U.S. Cl. ..... 430/622; 430/621; 430/623; 430/642; 530/355; 530/408

(58) Field of Search ..... 430/622, 621, 430/623, 642; 530/355, 408

(56) References Cited

U.S. PATENT DOCUMENTS

| | | | | | |
|---|---|---|---|---|---|
| 4,421,847 | A | | 12/1983 | Jung et al. | 430/621 |
| 4,772,397 | A | * | 9/1988 | Szucs et al. | 210/635 |
| 5,066,572 | A | * | 11/1991 | O'Connor et al. | 430/503 |
| 5,187,259 | A | | 2/1993 | Sterman et al. | 530/354 |
| 5,318,889 | A | * | 6/1994 | Bagchi et al. | 430/642 |
| 5,378,598 | A | * | 1/1995 | Bagchi et al. | 430/569 |
| 5,536,630 | A | * | 7/1996 | Bagchi et al. | 430/567 |
| 5,759,288 | A | * | 6/1998 | Young et al. | 134/25.4 |
| 5,834,232 | A | * | 11/1998 | Bishop et al. | 435/68.1 |
| 5,877,287 | A | * | 3/1999 | Lilja et al. | 530/355 |
| 6,080,843 | A | * | 6/2000 | Rainville et al. | 530/355 |

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

Disclosed is a method of producing a water-soluble chain-extended gelatin subjecting a source a source gelatin having a first isoelectric point, in aqueous solution, to a partial crosslinking reaction to form a reaction mixture comprising a partially crosslinked gelatin having a second isoelectric point, filtering the reaction mixture, adjusting a pH value of the filtered reaction mixture to a value equivalent to the second isoelectric point ±1.5, and concentrating, drying and pulverizing the pH-adjusted reaction mixture.

19 Claims, No Drawings

METHOD OF PRODUCING WATER-SOLUBLE CHAIN-EXTENDED GELATIN, GELATIN PRODUCED BY THE METHOD, AND SILVER HALIDE PHOTOGRAPHIC LIGHT-SENSITIVE MATERIAL CONTAINING THE GELATIN

CROSS-REFERENCE TO RELATED APPLICATIONS

This application is based upon and claims the benefit of priority from the prior Japanese Patent Application No. 2000-048166, filed Feb. 24, 2000, the entire contents of which are incorporated herein by reference.

BACKGROUND OF THE INVENTION

The present invention relates to a method of producing water-soluble chain-extended gelatin and, more particularly, to gelatin of this type exhibiting improved filtering characteristics when redissolved. The present invention further relates to the use of gelatin thus produced as a photographic component.

Silver salt light-sensitive materials have advanced by using a silver halide and gelatin. In particular, gelatin has a wide variety of effects on photographs and participates in all steps from the beginning to the end of silver salt photography, e.g., preparation of silver halide grains, coating, drying, storage, photographing, processing, and image storage. As the recent silver salt light-sensitive material preparation technologies are becoming precise, requirements for photographic gelatin are also becoming extremely strict.

Efforts have been made to meet these requirements, and one method is to modify gelatin. Of various modifying methods, U.S. Pat. No. 5,187,259 or Jpn. Pat. Appln. KOKAI Publication No. 56-2324 has disclosed a method of extending the chain (increasing the molecular weight) of gelatin while the gelatin is kept water-soluble (so-called water-soluble chain-extended gelatin). This water-soluble chain-extended gelatin is useful, on a support layer in the production of photographic elements, as a disperse dye carrier layer in the production of microfilm products or as a rapid film hardener carrier layer in color emulsion products. U.S. Pat. No. 5,187,259 and Jpn. Pat. Appln. KOKAI Publication No. 56-2324 describe that the viscosity of a solution using this gelatin is high, so a high coating rate can be used when the gelatin is applied to curtain coating. Additionally, the protective colloid properties of water-insoluble photographically useful substances, such as silver halide grains and disperse dyes, can be improved on the basis of the increased molecular weight.

Since the molecular weight is increased, however, the viscosity of the gelatin solution rises to increase the loads on individual operations. Also, even a low-concentration solution has a high gelation rate, so the solution is difficult to handle during the production. Furthermore, the effect on the yield is large, and this influences the producing cost.

When this gelatin is used, therefore, purification by an ion-exchange resin or ultrafiltration is impractical for the above reasons. Hence, it is necessary to perform drying and powdering by minimizing the number of producing steps. When this is the case, however, producing problems (coating suitability and coated surface condition failure) caused by the filtering characteristics arise if the gelatin is used as a photographic component. Any patents including the aforementioned disclosed patents do not describe improves of these problems after the reaction. So, it has been desired to improve the filtering characteristics of a solution when powder gelatin is redissolved.

BRIEF SUMMARY OF THE INVENTION

It is an object of the present invention to provide a water-soluble chain-extended gelatin producing method which improves the filtering characteristics of a solution prepared by redissolving a powder of gelatin, without applying any producing load.

The above object is achieved by the following means.

(1) A method of producing a water-soluble chain-extended gelatin, comprising the steps of:
- subjecting unreacted gelatin (to be referred to as source gelatin hereinafter) a source gelatin having a first isoelectric point, in aqueous solution, to a partial crosslinking reaction to form a reaction mixture comprising a partially crosslinked gelatin having a second isoelectric point;
- filtering the reaction mixture;
- adjusting a pH value of the filtered reaction mixture to a value equivalent to the second isoelectric point ±1.5; and
- concentrating, drying and pulverizing the pH-adjusted reaction mixture.

(2) The method described in (1), wherein the partial crosslinking reaction is performed by using a compound selected from the group consisting of a bis-(vinylsulfonyl) compound and a compound capable of activating a carboxyl group.

(3) The method described in (1), wherein the partial crosslinking reaction is performed by reacting the source gelatin with a compound selected from the group consisting of a bis-(vinilsulfonyl) compound and a compound capable of activating a carboxyl group in an amount of 0.25 to 10 mmol per 100 g of source gelatin, at a temperature of 40 to 65° C., and a pH of not less than a value equivalent to the first isoelectric point for 1 to 8 hours wherein the source gelatin is in a form of an aqueous solution with a gelatin concentration of 6 to 25% by mass.

(4) The method described in (2) or (3), wherein the bis-(vinylsulfonyl) compound is selected from compounds represented by formulas 1 and 2:

Formula 1

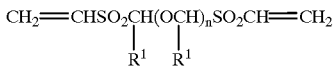

where each $R^1$ independently represents a hydrogen atom, an alkyl group, an aralkyl group or an aryl group, wherein these groups may be substituted, and n represents 0 or 1;

Formula 2

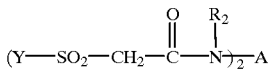

where Y represents a vinyl group, A represents a single bond or a divalent coupling group, and each $R^2$ independently represents a hydrogen atom or an alkyl group having 1 to 4 carbon atoms.

(5) The method described in claim (2) or (3), wherein the compound capable of activating a carboxyl group is selected from compounds represented by formulas 3 and 4:

Formula 3

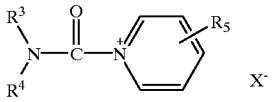

where each of $R^3$ and $R^4$ independently represents an alkyl group, an aralkyl group, or an aryl group, wherein $R^3$ and $R^4$ may be combined to form a heterocycle together with the nitrogen atom; $R^5$ represents an alkyl group, an alkoxy group, a dialkylamino group, or an N-alkylcarbamoyl group, and $X^-$ represents a monovalent anion, wherein if $R^5$ contains, as a substituent, a sulfo group, a sulfoxy group, or a sulfoamino group, the compound may form an intramolecular salt without $X^-$;

Formula 4

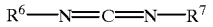

where $R^6$ represents an alkyl group, a cycloalkyl group, an alkoxyalkyl group, or an aralkyl group, and $R^7$ represents the group defined by $R^6$ of a group represented by formula 5:

Formula 5

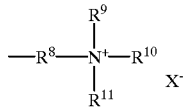

where $R^8$ represents an alkylene group, each of $R^9$ to $R^{11}$ independently represents an alkyl group, wherein one of $R^9$ to $R^{11}$ may be a hydrogen atom, and two of $R^9$ to $R^{11}$ may be combined to form a heterocycle together with the nitrogen atom.

(6) The method described in (3), wherein the source gelatin is selected from the group consisting of an acid-processed bone gelatin and a lime-processed bone gelatin.

(7) The Water-soluble chain-extended gelatin produced by the method described in any one of (1) to (6).

(8) A silver halide photographic light-sensitive material comprising the water-soluble chain-extended gelatin produced by the method described in any one of (1) to (6).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

Concerning a partial crosslinking reaction in a method of producing water-soluble chain-extended gelatin of the present invention, U.S. Pat. No. 5,187,259 and Jpn. Pat. Appln. KOKAI Publication No. 56-2324 may be refered. In this partial crosslinking reaction, a bis-(vinylsulfonyl) compound or a compound capable of activating a carboxyl group is used.

First, a bis-(vinylsulfonyl) compound will be explained below.

This bis-(vinylsulfonyl) compound is preferably selected from compounds represented by formulas 1 and 2 below.

Formula 1

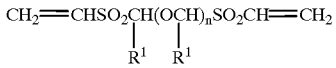

In formula 1, $R^1$ represents a hydrogen atom, an alkyl group having 1 to 20 carbon atoms (e.g., a methyl group, ethyl group, iso-propyl group, or n-butyl group), an aralkyl group having 6 to 20 carbon atoms (e.g., a benzyl group or phenethyl group), or an aryl group having 5 to 20 carbon atoms (e.g., a phenyl group, naphthyl group, or pyridyl group). These groups may be substituted. Examples of the substituent are a sulfonic acid group, a hydroxyl group, and a carboxyl group. $R^1$ is particularly preferably a hydrogen atom. n represents 0 or 1, preferably 0.

Practical examples of a compound represented by formula 1 will be presented below. However, the present invention is not limited to these examples.

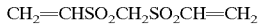

H-1

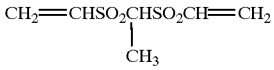

H-2

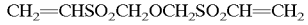

H-3

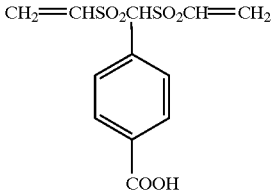

H-4

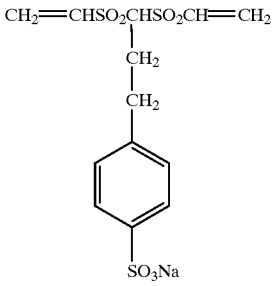

H-5

Formula 2 will be described below.

Formula 2

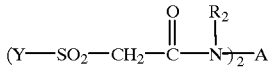

In formula 2, Y represents a vinyl group. A represents a single bond or a divalent coupling group. Although this divalent coupling group may be any group, it is preferably a cyclic or acyclic alkylene group having 1 to 10 carbon atoms in which one to three carbon atoms may be replaced by hetero atoms such as N, S, or O. The divalent coupling group is more preferably a chainlike hydrocarbon group having 1 to 5 carbon atoms. If the number of carbon atoms is 2 to 6, the group may be branched or straight-chained. This chain may also have a substituent such as an alkoxy (e.g., methoxy or ethoxy), a halogen (e.g., chloro or bromo), a hydroxy or an acetoxy. Each $R^2$ independently represents a hydrogen atom or an alkyl group having 1 to 4 carbon atoms. Practical examples of a compound represented by formula 2 will be presented below, but the present invention is not restricted to these examples.

$CH_2{=}CHSO_2CH_2CONHCH_2CH_2NHCOCH_2SO2CH{=}CH_2$ H-6

$CH_2{=}CHSO_2CH_2CONHCH_2CH_2CH_2NHCOCH_2SO_2CH{=}CH_2$ H-7

$CH_2{=}CHSO_2CH_2CONHCH_2NHCOCH_2SO_2CH{=}CH_2$ H-8

$CH_2{=}CHSO_2CH_2CONH{-}NHCOCH_2SO_2CH{=}CH_2$ H-9

H-10

$CH_2{=}CHSO_2CH_2CON(CH_3)CH_2CH_2N(CH_3)COCH_2SO_2CH{=}CH_2$

A compound capable of activating a carboxyl group in gelatin will be described below.

This compound capable of activating a carboxyl group in gelatin is preferably selected from groups represented by formula 3 below and formula 4 to be presented later.

Formula 3

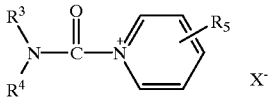

In formula 3, each of $R^3$ and $R^4$ independently represents an alkyl group having 1 to 10 carbon atoms (e.g., a methyl group, ethyl group, or 2-ethylhexyl group), an aralkyl group having 7 to 10 carbon atoms (e.g., a benzyl group or phenethyl group), or an aryl group having 6 to 15 carbon atoms (e.g., a phenyl group or naphthyl group). $R^3$ and $R^4$ preferably combine to form a heterocycle together with the nitrogen atom. Examples of the ring are a pyrrolidine ring, a piperazine ring, and a morpholine ring, and a morpholine ring is particularly preferred. $R^5$ represents a hydrogen atom, a halogen atom, a carbamoyl group, a sulfo group, an ureido group, an alkyl group having 1 to 10 carbon atoms, an alkoxy group having 1 to 10 carbon atoms, or a dialkylamino group having 2 to 20 carbon atoms. If $R^5$ is an alkoxy group, an alkyl group, a dialkylamino group, or an N-alkylcarbamoyl group, these groups may be further substituted. Examples of the substituent are a halogen atom, a carbamoyl group, a sulfo group, a sulfoxy group, and an ureido group. $X^-$ represents a monovalent anion which is a counter ion of N-carbamoylpyridinium salt. If a substituent of $R^5$ contains a sulfo group, a sulfoxy group, or a sulfoamino group, the compound may form an intramolecular salt without $X^-$. Preferred examples of the monovalent anion are halide ion, sulfuric acid ion, sulfonate ion, $ClO_4^-$, $BF_4^-$, and $PF_6^-$. It is particularly preferable to form intramolecular salt.

Practical examples of a compound represented by formula 3 will be presented below. However, the present invention is not limited to these examples.

H-11

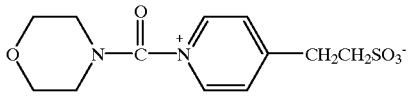

H-12

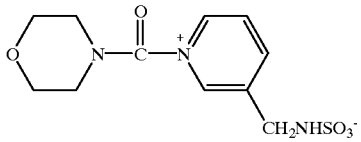

H-13

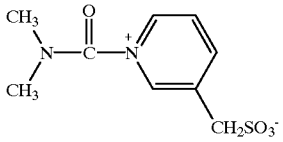

H-14

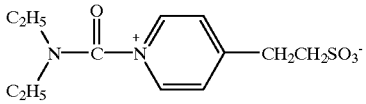

H-15

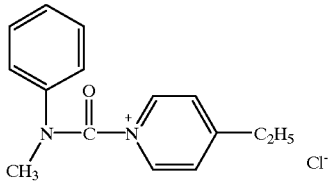

Formula 4 will be explained below.

$R^6{-}N{=}C{=}N{-}R^7$ wherein $R^6$ represents an alkyl group having 1 to 10 carbon atoms (e.g., a methyl group, ethyl group, or 2-ethylhexyl group), a cycloalkyl group having 5 to 8 carbon atoms (e.g., a cyclohexyl group), an alkoxyalkyl group having 3 to 10 carbon atoms (e.g., a methoxyethyl group), or an aralkyl group having 7 to 15 carbon atoms (e.g., a benzyl group or phenethyl group).

$R^7$ represents any of the groups defined by $R^6$ or a group represented by formula 5.

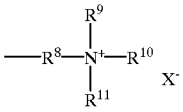

wherein $R^8$ represents an alkylene group having 2 to 4 carbon atoms (e.g., an ethylene group or propylene group). Each of $R^9$ to $R^{11}$ independently represents an alkyl group having 1 to 6 carbon atoms (e.g., a methyl group or ethyl group). One of $R^9$ to $R^{11}$may be a hydrogen atom. Also, two of $R^9$ to $R^{11}$ preferably combine to form a heterocycle (e.g., a pyrrolidine ring, piperazine ring, or morpholine ring) together with the nitrogen atom. $R^9$ to $R^{11}$ may also be substituted, and preferred examples of the substituent are a substituted or nonsubstituted carbamoyl group and sulfo group. $X^-$ represents a monovalent anion, and examples are halide ion, sulfuric acid ion, sulfonate ion, $ClO_4^-$, $BF_4^-$, and $PF_6^-$. If $R^{10}$ is substituted by a sulfo group, the group represented by formula 5 may form an intramolecular salt without $X^-$.

Practical examples of a compound represented by formula 4 will be presented below. However, the present invention is not limited to these examples.

H-16

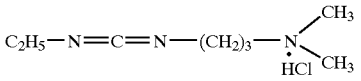

H-17

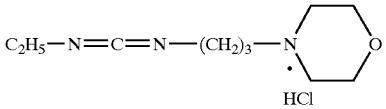

H-18

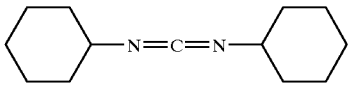

H-19

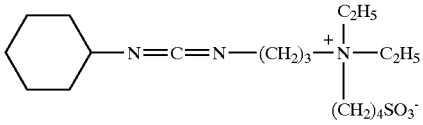

H-20

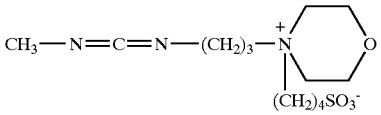

Favorable partial crosslinking reaction conditions in the present invention are: the addition amount of a bis-(vinylsulfonyl) compound represented by formula 1 or 2 above or of a compound capable of activating a carboxyl group, represented by formula 3 or 4 above, is 0.25 to 10 mmol per 100 g of the dried mass of the source gelatin to be chain-extended; the reaction temperature is 40 to 65° C.; the reaction pH value is equivalent to the isoelectric point of the source gelatin or more; the reaction time is 1 to 8 hr; and the reaction gelatin concentration is 6 to 25 mass %. More favorable partial crosslinking reaction conditions are: the addition amount of a bis-(vinylsulfonyl) compound represented by formula 1 or 2 or of a compound capable of activating a carboxyl group, represented by formula 3 or 4, is 0.25 to 8 mmol per 100 g of the dried mass of the source gelatin to be chain-extended; the reaction temperature is 45 to 60° C.; the reaction pH value ranges from a value equivalent to the isoelectric point of the source gelatin to a value equivalent to the isoelectric point +3; the reaction time is 1 to 6 hr; and the reaction gelatin concentration is 6 to 20 mass %. Most favorable partial crosslinking reaction conditions are: the addition amount of a bis-(vinylsulfonyl) compound represented by formula 1 or 2 or of a compound capable of activating a carboxyl group, represented by formula 3 or 4, is 0.25 to 5 mmol per 100 g of the dried mass of the source gelatin to be chain-extended; the reaction temperature is 50 to 60° C.; the reaction pH value ranges from a value equivalent to the isoelectric point of the source gelatin to a value equivalent to the isoelectric point +2.5; the reaction time is 1 to 5 hr; and the reaction gelatin concentration is 7 to 18 mass %. A bis-(vinylsulfonyl) compound represented by formula 1 or 2 or a compound capable of activating a carboxyl group, represented by formula 3 or 4, can be added at once in the form of an aqueous or alcohol solution or can be added by dropping the solution over 30 min to 3 hr. This compound is preferably added by dropping its solution over 30 min to 2 hr. Particularly preferably, the compound is added by dropping its solution over 30 min to 1.5 hr. The concentration of the solution is preferably 0.5 to 5 mass %, and more preferably, 0.5 to 2 mass %.

Gelatin to be chain-extended will be explained below. The major supply sources of photographic gelatin are beef skins and bones. Although the both materials can be used, gelatin produced from bones is preferred. Also, the source gelatin is roughly classified in accordance with the processing method. Although both of acid-processed gelatin and alkali (lime)-processed gelatin can be used, alkali(lime)-processed gelatin is preferred. The isoelectric points of acid-processed gelatin and alkali(lime)-processed gelatin are different. On the other hand, in the crosslinking reaction mentioned earlier there is almost no difference between the isoelectric point of the source gelatin to be extended and the isoelectric point of the chain-extended gelatin. Therefore, two or more of different source gelatins to be extended can be used. When this is the case, however, the difference between the isoelectric points of these source gelatins is preferably 1.5 or less, and more preferably, 1 or less.

When the above partial crosslinking reaction completes, the steps of filtration, concentration, drying, and powdering start. The present invention is characterized in that a pH adjusting step is inserted between filtration and concentration. That is, after a reaction aqueous solution obtained by the partial crosslinking reaction described above is filtered, the pH value of this reaction aqueous solution is adjusted within the range of value equivalent to the isoelectric point of the produced water-soluble chain-extended gelatin ±1.5. This pH value preferably ranges from the value equivalent to the isoelectric point −0.5 to the value equivalent to the isoelectric point +1.0, and more preferably, from the value equivalent to the isoelectric point −0.5 to the value equivalent to the isoelectric point +0.5. This makes it possible to improve the filtering characteristics of a solution when powder gelatin is redissolved.

Preferred examples of an acid used in the adjustment are sulfuric acid, hydrochloric acid, and nitric acid. Preferred examples of an alkali used in the adjustment are NaOH and KOH. Of these examples, sulfuric acid and NaOH are most preferred as an acid and alkali, respectively. The partial crosslinking reaction is preferably performed at pH equal to or higher than the isoelectric point of the source gelatin. So, it is desirable to adjust the pH within the target range by a minimum necessary amount of an acid. The concentration of an acid or alkali used in the adjustment is preferably 1 to 5 mol/L, and more preferably, 1 to 3 mol/L. The temperature of the pH adjustment is preferably 40 to 60° C., and more preferably, 40 to 50° C.

Subsequently, gelatin having a proper grain size is obtained through the steps of concentration, drying, and powdering. The series of steps can be performed by using methods described in known patents and scientific literature. The water-soluble chain-extended gelatin thus obtained can be used in a photographic element. This photographic element is appropriately a material sensitive to light, laser, or X-ray irradiation. The element is selected from a black-and-white reversal film, black-and-white film, color negative film, color reversal film, film on which a light-sensitive photographic component is digital-scanned, black-and-white reversal paper, black-and-white paper, color paper, reversal color paper, and paper on which a light-sensitive photographic component is exposed to laser irradiation from a digital database. The photographic element is particularly preferably a color negative film. One example is Jpn. Pat. Appln. KOKAI Publication No. 11-305396, the disclosure of which is incorporated herein by reference.

The gelatin was redissolved and added to various components, and these photographic elements were coated with the resultant gelatin solution. Consequently, good filtering characteristics of the gelatin solution caused no surface condition failure and imparted producing suitability.

The present invention will be described by way of its examples. These examples explained below merely describe the instructions herein mentioned in more detail and hence do not restrict the present invention.

EXAMPLE 1

Production of Polymeric Gelatin A Using Bis-(Vinylsulfonyl) Compound 568.2 g of lime-processed bone gelatin (isoelectric point 5.0) were added to a 5-L three-necked flask, and 4,260 g of pure water were added to the gelatin. After the resultant material was intensely stirred for 1 min, the stirring was stopped, and the material was allowed to swell for 1 hr at room temperature. After that, the internal temperature was raised to 60° C., and the material was dissolved under heating for 1 hr. The pH of the solution was adjusted to 6.8 by using an aqueous 5-mol/L sodium hydroxide solution. After this pH adjustment, 146 g of an aqueous 1-mass % solution of a bis-(vinylsulfonyl) compound (H-6) were dropped over 1 hr while the internal temperature was held at 60° C. After the dropping, the resultant material was allowed to react for 3 hr at the same temperature. The reacted material was filtered, and the pH of the filtrate was adjusted to 5.0 by 2-mol/L sulfuric acid. This filtrate was concentrated to have a gelatin concentration of 27 mass %. The concentrated filtrate was dried and powdered to obtain target water-soluble polymeric gelatin A. The isoelectric point of this polymeric gelatin was 5.0. The molecular weight was measured on the basis of the PAGI method. In a GPC profile, the ratio (V/α) of a void portion (approximately 2,000,000 or more) of the elimination limit of a column used (GS-620) to the height of the α chain (molecular weight 100,000) was 0.40.

EXAMPLE 2

Production of Polymeric Gelatin B Using Compound Capable of Activating Carboxyl Group 568.2 g of lime-processed bone gelatin (isoelectric point 5.0) were added to a 5-L three-necked flask, and 4,200 g of pure water were added to the gelatin. After the resultant material was intensely stirred for 1 min, the stirring was stopped, and the material was allowed to swell for 1 hr at room temperature. After that, the internal temperature was raised to 60° C., and the material was dissolved under heating for 1 hr. The pH of the solution was adjusted to 6.8 by using an aqueous 5-mol/L sodium hydroxide solution. After this pH adjustment, 180 g of an aqueous 1-mass % solution of a compound (H-16) capable of activating a carboxyl group were dropped over 1 hr while the internal temperature was held at 60° C. After the dropping, the resultant material was allowed to react for 3 hr at the same temperature. The reacted material was filtered, and the pH of the filtrate was adjusted to 5.0 by 2-mol/L sulfuric acid. This filtrate was concentrated to have a gelatin concentration of 25 mass %. The concentrated filtrate was dried and powdered to obtain target water-soluble polymeric gelatin B. The isoelectric point of this polymeric gelatin was 5.1. The molecular weight was measured on the basis of the PAGI method. In a GPC profile, the ratio (V/α) of a void portion (approximately 2,000,000 or more) of the elimination limit of a column used (GS-620) to the height of the a chain (molecular weight 100,000) was 0.41.

pH Dependence of Filtering Characteristics

Subsequently, each of the polymeric gelatins A and B were partially crosslinked and filtered. The filtrate was subdivided, and the pH's of these subdivided filtrates were adjusted to different values (pH 3 to 9). The resultant subdivided filtrates were concentrated, dried, and powdered. The powders were redissolved at 50° C. to prepare 6.7-mass % solutions. The filtering characteristics of these solutions were examined by an FC filter (pore size 3 μm) produced by Fuji Photo Film Co., Ltd. That is, each solution was passed at a constant flow rate, and the filtration pressure rise (filtration pressure after 6 min−filtration pressure after 1 min) was measured. The results are shown in Tables 1 and 2.

TABLE 1

| Polymeric Gelatin A (isoelectric point 5.0) | | | | | | | | |
|---|---|---|---|---|---|---|---|---|
| Adjusted pH value after filtration | 3.5 | 4 | 4.5 | 5 | 5.5 | 6 | 6.5 | 7 |
| V/α ratio | 0.20 | 0.25 | 0.38 | 0.40 | 0.40 | 0.41 | 0.42 | 0.44 |
| Filtration pressure rise | 0 | 0 | 0 | 0 | 79 | 686 | 4903 | ∞ |

TABLE 2

| Polymeric Gelatin B (isoelectric point 5.0) | | | | | | | | |
|---|---|---|---|---|---|---|---|---|
| Adjusted pH value after filtration | 3.5 | 4 | 4.5 | 5 | 5.5 | 6 | 6.5 | 7 |
| V/α ratio | 0.22 | 0.32 | 0.40 | 0.40 | 0.40 | 0.41 | 0.43 | 0.46 |
| Filtration pressure rise | 0 | 0 | 0 | 0 | 69 | 392 | 3432 | ∞ |

The filtering characteristics of the redissolved gelatins of both the polymeric gelatins A and B dramatically changed in accordance with the pH values after the reaction; the values near the isoelectric points were the best. When the pH value of each polymeric gelatin was adjusted to 7, higher by +2 than the value equivalent to the isoelectric point, filtration was entirely impossible because the solution clogged the filter in the middle of filtration. On the other hand, when the pH value of each polymeric gelatin was adjusted to 3.5, lower by −1.5 than the value equivalent to the isoelectric point, the filtering characteristics were of no problem. However, the V/α ratio shows a reduction in the polymer component. This is presumably because hydrolysis occurred during concentration and drying. Accordingly, caution should be exercised on the filtering characteristics when lowering the pH value after the reaction from the value equivalent to the isoelectric point.

Additionally, a silver halide photographic light-sensitive material was produced following the same procedures as in Example 1 described in Jpn. Pat. Appln. KOKAI Publication No. 11-305396, the disclosure of which is incorporated herein by reference, except that gelatin in the seventh layer (interlayer) was totally replaced with the polymeric gelatin A (the final adjusted pH value after filtration was 5) obtained in Example 1 described above. Good filtering characteristics of the gelatin solution caused no surface condition failure (roughness) and imparted producing suitability. As a comparative example, an identical silver halide photographic light-sensitive material was produced using the polymeric gelatin shown in Table 1, which was prepared by adjusting the final pH value after filtration to 7 in the method of producing the polymeric gelatin A. Consequently, a surface condition failure occurred. Note that the dispersion stability of an emulsion in the seventh layer (interlayer) prepared using the polymeric gelatin A (the final adjusted pH value after filtration was 5) was much more improved than when non-polymeric gelatin was used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a water-soluble chain-extended gelatin, comprising the steps of:

subjecting an alkali (lime)-processed gelatin as a source gelatin having a first isoelectric point, in aqueous solution, to a partial crosslinking reaction to form a reaction mixture comprising a partially crosslinked gelatin having a second isoelectric point;

filtering said reaction mixture;

adjusting a pH value of said filtered reaction mixture to a value equivalent to said second isoelectric point ±1.5; and concentrating, drying and pulverizing said pH-adjusted reaction mixture.

2. The method according to claim 1, wherein the partial crosslinking reaction is performed by using a compound selected from the group consisting of a bis-(vinylsulfonyl) compound and a compound capable of activating a carboxyl group.

3. The method according to claim 1, wherein the partial crosslinking reaction is performed by reacting said source gelatin with a compound selected from the group consisting of a bis-(vinilsulfonyl) compound and a compound capable of activating a carboxyl group in an amount of 0.25 to 10 mmol per 100 g of source gelatin, at a temperature of 40 to 65° C., and a pH of not less than a value equivalent to said first isoelectric point for 1 to 8 hours wherein said source gelatin is in a form of an aqueous solution with a gelatin concentration of 6 to 25% by mass.

4. The method according to claim 2, wherein the bis-(vinylsulfonyl) compound is selected from compounds represented by formulas 1 and 2:

Formula 1

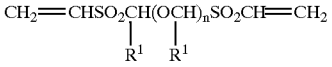

where each $R^1$ independently represents a hydrogen atom, an alkyl group, an aralkyl group or an aryl group, wherein these groups may be substituted, and n represents 0 or 1;

Formula 2

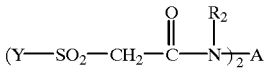

where Y represents a vinyl group, A represents a single bond or divalent coupling group, and each $R^2$ independently represents a hydrogen atom or an alkyl group having 1 to 4 carbon atoms.

5. The method according to claim 3, wherein the bis-(vinylsulfonyl) compound is selected from compounds represented by formulas 1 and 2:

Formula 1

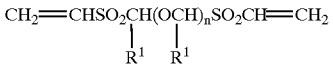

where each $R^1$ independently represents a hydrogen atom, an alkyl group, an aralkyl group or an aryl group, wherein these groups may be substituted, and n represents 0 or 1;

Formula 2

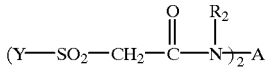

where Y represents a vinyl group, A represents a single bond or divalent coupling group, and each $R^2$ independently represents a hydrogen atom or an alkyl group having 1 to 4 carbon atoms.

6. The method according to claim 2, wherein the compound capable of activating a carboxyl group is selected from compounds represented by formulas 3 and 4:

Formula 3

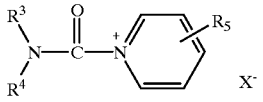

where each of $R^3$ and $R^4$ independently represents an alkyl group, an aralkyl group, or an aryl group, wherein $R^3$ and $R^4$ may be combined to form a heterocycle together with the nitrogen atom; $R^5$ represents an alkyl group, an alkoxy group, a dialkylamino group, or an N-alkylcarbamoyl group, and $X^-$ represents a monovalent anion, wherein if $R^5$ contains, as a substituent, a sulfo group, a sulfoxy group, or a sulfoamino group, said compound may form an intramolecular salt without $X^-$;

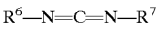

Formula 4 where $R^6$ represents an alkyl group, a cycloalkyl group, an alkoxyalkyl group, or an aralkyl group, and $R^7$ represents the group defined by $R^6$ of a group represented by formula 5:

Formula 5

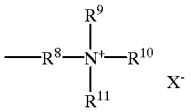

where $R^8$ represents an alkylene group, each of $R^9$ to $R^{11}$ independently represents an alkyl group, wherein one of $R^9$ to $R^{11}$ may be a hydrogen atom, and two of $R^9$ to $R^{11}$ may be combined to form a heterocycle together with the nitrogen atom.

7. The method according to claim 3, wherein the compound capable of activating a carboxyl group is selected from compounds represented by formulas 3 and 4:

Formula 3

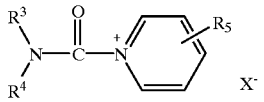

where each of $R^3$ and $R^4$ independently represents an alkyl group, an aralkyl group, or an aryl group, wherein $R^3$ and $R^4$ may be combined to form a heterocycle together with the nitrogen atom; $R^5$ represents an alkyl group, an alkoxy group, a dialkylamino group, or an N-alkylcarbamoyl group, and $X^-$ represents a monovalent anion, wherein if $R^5$ contains, as a substituent, a sulfo group, a sulfoxy group, or a sulfoamino group, said compound may form an intramolecular salt without $X^-$;

$$R^6—N=C=N—R^7$$ Formula 4 where $R^6$ represents an alkyl group, a cycloalkyl group, an alkoxyalkyl group, or an aralkyl group, and $R^7$ represents the group defined by $R^6$ of a group represented by formula 5:

Formula 5

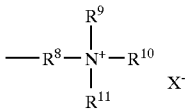

where $R^8$ represents an alkylene group, each of $R^9$ to $R^{11}$ independently represents an alkyl group, wherein one of $R^9$ to $R^{11}$ may be a hydrogen atom, and two of $R^9$ to $R^{11}$ may be combined to form a heterocycle together with the nitrogen atom.

8. The Water-soluble chain-extended gelatin produced by the method according to claim 1.

9. The Water-soluble chain-extended gelatin produced by the method according to claim 2.

10. The Water-soluble chain-extended gelatin produced by the method according to claim 3.

11. The Water-soluble chain-extended gelatin produced by the method according to claim 4.

12. The Water-soluble chain-extended gelatin produced by the method according to claim 5.

13. The Water-soluble chain-extended gelatin produced by the method according to claim 6.

14. A silver halide photographic light-sensitive material comprising the water-soluble chain-extended gelatin produced by the method according to claim 1.

15. A silver halide photographic light-sensitive material comprising the water-soluble chain-extended gelatin produced by the method according to claim 2.

16. A silver halide photographic light-sensitive material comprising the water-soluble chain-extended gelatin produced by the method according to claim 3.

17. A silver halide photographic light-sensitive material comprising the water-soluble chain-extended gelatin produced by the method according to claim 4.

18. A silver halide photographic light-sensitive material comprising the water-soluble chain-extended gelatin produced by the method according to claim 5.

19. A silver halide photographic light-sensitive material comprising the water-soluble chain-extended gelatin produced by the method according to claim 6.

* * * * *